United States Patent [19]

Hartman

[11] Patent Number: 4,840,307

[45] Date of Patent: Jun. 20, 1989

[54] POSTBOX SIGNAL

[76] Inventor: Janet A. Hartman, 1157 Pugh Rd., Wayne, Pa. 19087

[21] Appl. No.: 189,729

[22] Filed: May 3, 1988

[51] Int. Cl.[4] ..... B65D 91/00

[52] U.S. Cl. ..... 232/35; 232/34

[58] Field of Search ..... 232/17, 34, 35

[56] References Cited

U.S. PATENT DOCUMENTS

| | | | |
|---|---|---|---|
| 2,592,555 | 4/1952 | Gensmer | 232/35 |
| 2,730,298 | 1/1956 | Haserodt | 232/35 |
| 3,095,140 | 6/1963 | Buedingen | 232/35 |
| 3,523,639 | 8/1970 | Wiebe | 232/35 |

*Primary Examiner*—Robert W. Gibson, Jr.
*Attorney, Agent, or Firm*—Morris Kaplan

[57] ABSTRACT

Mailbox signal device is comprised essentially of two plates, a support plate that mounts onto a postbox by integral plate tab elements that position beneath the postbox latch member and a signal plate that is (a) at one end pivotally fixed to the support plate, (b) biased to an upright position, (c) has an extending tab member at its other end that operatively associates with the postbox closure to be retained in a folded position and (d) automatically is biased to said upright position when the tab member is freed by opening of said closure.

3 Claims, 1 Drawing Sheet

FIG 1
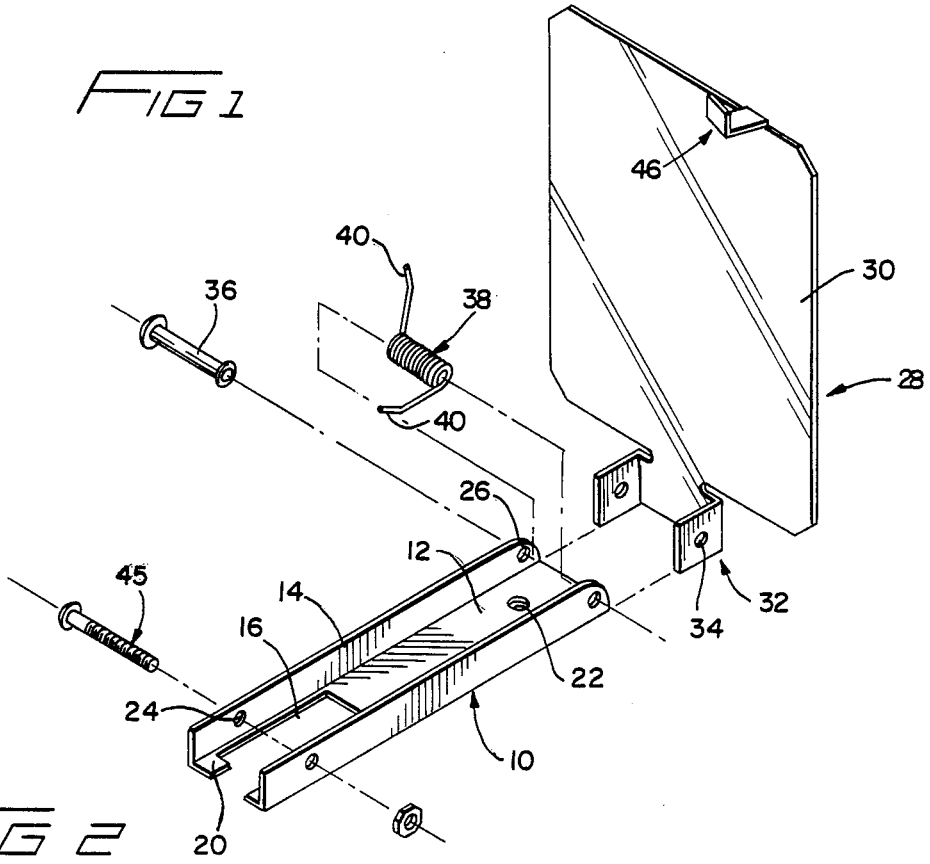
FIG 2
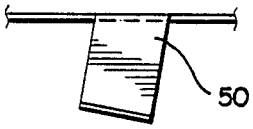
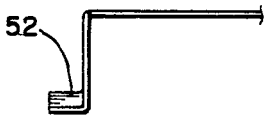
FIG 3
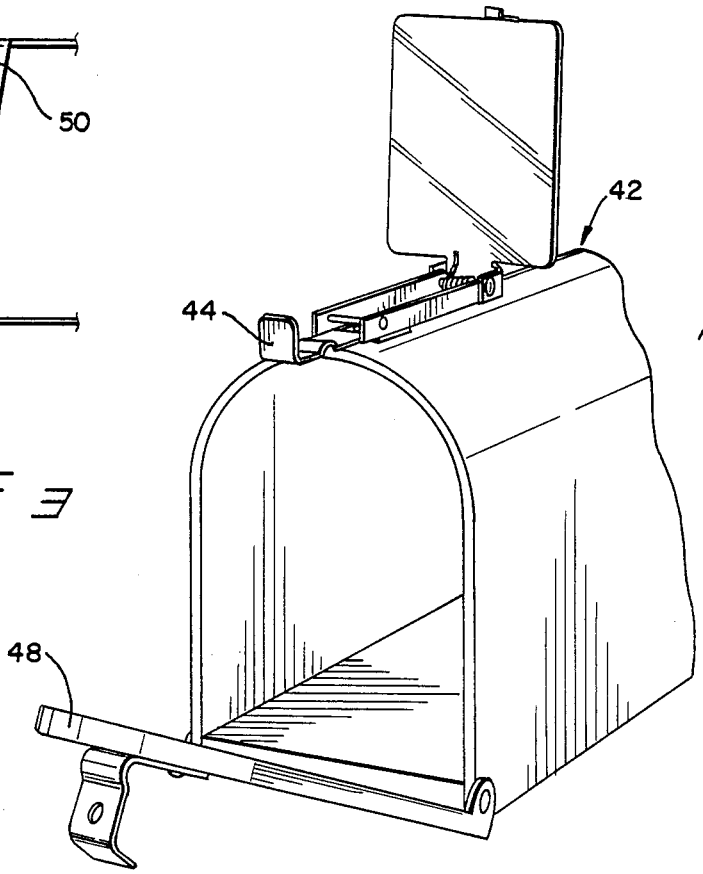
FIG 4

POSTBOX SIGNAL

FIELD OF THE INVENTION

The present invention relates to an improved and novel postbox signal device.

BACKGROUND OF THE INVENTION

It is well-known to provide the conventional rural postbox with a signal means whereby to indicate a delivery therein and wherein a simple act of postbox closure opening automatically results in a signal flag movement to a delivery indicating position; see for instance the U.S. Patents to Hollenbach, U.S. Pat. Nos. 4,412,646, issued Nov. 1, 1983 and to Morgrey, 4,570,846, issued Feb. 18, 1986.

For various reasons, these known devices are not fully satisfactory. The Morgrey device, see FIG. 3 therein, and Ulery, U.S. Pat. No. 1,141,024, issued May 25, 1915, are for instance each considered to require an undue number of structural parts and mechanical sophistication. Hollenbach's device relies on the uncertain integrity of adhesive and surface characteristics for mounting purposes and either does not require signal operation as a requisite to delivery with regard to the non-closure receptacle species, or the signal device of FIGS. 8, 9 may be operated independent of closure movement.

Other devices for the purpose are sold disassembled, since the mechanics and design thereof would otherwise require awkward packing and handling.

SUMMARY OF THE INVENTION

The improved and novel postbox signal device of the present invention is in general comprised of a relatively fewer mechanical parts which are each a simple element of structure.

It is a object of the invention that these parts easily assemble into an uncomplicated compact combination that is pleasing in design, inexpensive and easy to manufacture, be fabricated of conventional materials, be easily mounted onto a postbox without requiring use of special tools or postbox mutilation, and in utilization, be signal-responsive to postbox closure operation.

For a more fully developed presentation of the invention and a preferred embodiment thereof, reference is made to the following descriptive matter: attached drawings and claims.

BRIEF DESCRIPTION OF THE DRAWINGS

FIG. 1 is, in perspective, an exploded view of a preferred embodiment of the invention and in functional mode indicates that a delivery has been made.

FIG. 2 is an elevation of the front edge of the signal plate.

FIG. 3 is a partial elevational side view, partly in section, of the signal plate.

FIG. 4 is a perspective view of the device mounted onto a postbox and having the signal plate in position to indicate delivery.

DETAILED DESCRIPTION OF THE DRAWINGS

Referring to the drawings which show a preferred embodiment of the invention, and wherein like numerals indicate like structure, there is shown in FIG. 1 a channeled mounting member 10 comprising an elongated bottom plate 12 having side walls 14. An elongated slot 16 extends from a free or front end 18 of the plate. The plate is formed with opposed tangs or tabs 20, which narrow the open end of said slot, and with an aperture 22 at the rear thereof. Pairs of opposed apertures 24, 26 are formed in the side walls, at the front and rear sections thereof.

A flag, signal, or indicator member 28 comprises a signal plate 30 having at one end a U-shaped portion 32 adapted to nestably and pivotally associate with the rear section of the channeled mounting member whereat a pair of aligned apertures 34, in the side walls of the U-shaped portion, associate with side wall apertures 26 whereby to accommodate, preferably a hollow rivet, shaft member 36.

The extent of pivotal movement of the signal member is from that lying on the elongations of the channel member side walls to an open position 90° therefrom, whereat a stop is formed by the rear edge surfaces of the channel member and the inside end face of the U-shaped portion. In this operative association of parts, the U-shaped portion is external of the channeled mounting member. The nesting and stop-function arrangement of parts could obviously be reversed. To bias the signal member to said open position, a helical spring 38 is located on said shaft. The spring ends, which bear against the flag plate and channel plate respectively, are configured with inward bends 40 whereby to inhibit defacement of the associated plate surfaces.

The signal device of the present invention is adapted to be mounted on a conventional postbox 42 having a latch bracket 44 by inserting the latch bracket through slot 16, lifting slightly on the latch bracket and sliding the tabs 20 thereunder. Release of the latch bracket should normally retain the signal device in place. To lock the signal device in place, a threaded fastener 45 is inserted through side wall apertures 24 whereby to clamp said device onto the latch bracket.

The device could also be locked in place by utilizing bottom plate aperture 42, but such use would require mutilation of the postbox and is not preferred.

The in-place location of the signal device is determined by positioning the signal plate tab extension 46, which is at the distal end of said plate, to operatively associate with postbox closure 48. With the latter in a closed-box relationship and the signal plate in a down or folded position, the tab extension is locked in place by the postbox closure flange. Opening of said closure frees the signal plate which, influenced by the bias of spring 32, snaps to its upright or open position. Material may then be delivered to the box, and the box closed; the flag plate remaining in its raised position as a signal of delivery.

For best viewing and for economy of materials, the signal device is located on the postbox topmost surface. Since the latter also generally locates the postbox latch bracket, the tab extension is expediently formed at an intermediate side section of the associated signal plate edge.

The tab extension is generally L-shaped and depends from said signal plate edge. If the postbox were rectangular in transverse configuration, then the L-shaped tab would be of regular dimensional characteristics.

As illustrated, the postbox has an arcuate top section and, accordingly, the tab extension has the depending leg 50 fabricated on a bias and a forwardly extending leg 52, which is generally normal to the depending element, is inclined in the direction of the associated section of closure flange; see FIGS. 2, 3. Obviously, the cut and bend of tab extension fabrication is a matter of mechanical expediency.

The embodiments shown and described is only illustrative of the present invention and is not to be construed as being delimitive thereof, since once apprised of the invention, changes in structure would be readily apparent to one skilled in the art. Hence, the present invention includes all modifications of structure encompassed within the spririt and scope of the following claims.

I claim:

1. A postbox signal device comprising:

a support plate having integral therewith means for mounting onto a conventional rural type of postbox without the requirement of postbox mutilation, as for instance a postbox aperture to accommodate a fastener, or of additional materials to effect said mounting:

a signal plate pivotally secured at one end to the support plate and foldable thereon to form a compact relatively planar mass adapted for ease of handling;

a spring means biasing the signal plate to an open or unfolded position;

said integral means for mounting comprising horizontally extending opposed tab elements that are adapted to operatively associate with the horizontal section of a conventional postbox latch member for retaining the signal device in operative position on the postbox;

said support plate having an elongated, open-ended slot at the free end thereof, the tab elements being disposed at said open end in the plane of the support plate, and the plate thus configured to facilitate assembly of the device as said relatively planar mass;

said slotted configuration being adapted to receive therethrough a said horizontal section of a conventional postbox latch member whereby said signal device may be easily mounted on said postbox by inserting the latch member through the slot, lifting slightly on the latch member, sliding the tab elements between the latch member and the postbox to an operative position, and then releasing the latch member whereby the signal device is retained at said operative position; and a tab member extending outwardly from the free end of the signal plate and adapted to operatively associate with the postbox closure for retention in the folded position and whereby opening of said closure frees the signal plate for movement to an upright position to normally signal a delivery to the postbox.

2. A postbox signal device as in claim 1, wherein said support plate has upstanding side walls adapted to accommodate a said postbox latch member therebetween; said side walls having opposed and aligned apertures therein; and fastener means operatively associated with said apertures whereby a mounted signal device may be locked onto a said latch member.

3. A postbox signal device as in claim 1 wherein said outwardly extending tab member has an initial portion that extends downwardly from said free end of the support plate and the outwardly extending portion is downwardly skewed for conformance with the configuration of a said postbox.

* * * * *